US009481176B2

(12) United States Patent
Nakano

(10) Patent No.: US 9,481,176 B2
(45) Date of Patent: Nov. 1, 2016

(54) IMAGE PRINTING APPARATUS

(71) Applicant: FUJIFILM Corporation, Tokyo (JP)
(72) Inventor: Takuma Nakano, Kanagawa (JP)
(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 15/079,705

(22) Filed: Mar. 24, 2016

(65) Prior Publication Data

US 2016/0200106 A1 Jul. 14, 2016

Related U.S. Application Data

(63) Continuation of application No. PCT/JP2014/073476, filed on Sep. 5, 2014.

(30) Foreign Application Priority Data

Oct. 23, 2013 (JP) ..... 2013-220133

(51) Int. Cl.
*B41J 2/165* (2006.01)

(52) U.S. Cl.
CPC ..... *B41J 2/16505* (2013.01); *B41J 2/16508* (2013.01); *B41J 2/16526* (2013.01); *B41J 2/16588* (2013.01)

(58) Field of Classification Search
CPC ..... B41J 2/16505; B41J 2/16508; B41J 2/16511; B41J 2/16514; B41J 2/16526; B41J 2/16588; B41J 2/1721; B41J 2/1728
See application file for complete search history.

(56) References Cited

U.S. PATENT DOCUMENTS 5,835,109 A * 11/1998 Uchida ..... B41J 2/16508 347/24
5,984,451 A * 11/1999 Muraki ..... B41J 2/16508 347/29
6,203,136 B1 * 3/2001 Takahashi ..... B41J 2/16508 347/29

(Continued)

FOREIGN PATENT DOCUMENTS

| | | | |
|---|---|---|---|
| JP | 2005-074767 | A | 3/2005 |
| JP | 2005-329551 | A | 12/2005 |
| JP | 2011-183730 | A | 9/2011 |

OTHER PUBLICATIONS

International Search Report—PCT/JP2014/073476 mailed Dec. 9, 2014.
Written Opinion—PCT/JP2014/073476 mailed Dec. 9, 2014.

*Primary Examiner* — Anh T. N. Vo
(74) *Attorney, Agent, or Firm* — Studebaker & Brackett PC

(57) ABSTRACT

The image printing apparatus comprises: a droplet-discharging head in which a plurality of head modules including nozzle surfaces in which a plurality of nozzles discharging liquid are disposed are fixed and joined by head module support members and the nozzle surfaces are inclined with respect to a horizontal plane; a receiving member that receives the liquid discharged from the nozzles in the case where the droplet-discharging head performs pressure purging; and a liquid infiltration-preventing pad that is provided in the receiving member, comes into contact with the droplet-discharging head during the pressure purging, and prevents the ink, which is discharged by the pressure purging, from infiltrating into gaps between the head modules. The liquid infiltration-preventing pad is made of a non-absorbent material, and has a flow passage in which the liquid discharged by the pressure purging is collected by the inclination of the nozzle surfaces.

20 Claims, 13 Drawing Sheets

(56) References Cited

U.S. PATENT DOCUMENTS 6,991,315 B2 * 1/2006 Nakamura ..... H05B 33/10 347/12
7,296,874 B2 * 11/2007 Horio ..... B41J 2/16585 347/29
7,901,033 B2 * 3/2011 Nishida ..... B41J 2/16508 347/22
8,147,028 B2 * 4/2012 Ito ..... B41J 2/16579 347/19

* cited by examiner

IMAGE PRINTING APPARATUS

CROSS-REFERENCE TO RELATED APPLICATIONS

This application is a Continuation of PCT International Application No. PCT/JP2014-073476 filed on Sep. 5, 2014, which claims priority under 35 U.S.C. §119 (a) to Japanese Patent Application No. 2013-220133. Each of the above application(s) is hereby expressly incorporated by reference, in its entirety, into the present application.

BACKGROUND OF THE INVENTION

1. Field of the Invention

The present invention relates to an image printing apparatus, and more particularly, to an image printing apparatus comprising droplet-discharging heads in which a plurality of head modules are joined.

2. Description of the Related Art

An inkjet recording apparatus for forming an image by discharging ink to a recording medium, which is to be conveyed, from heads is known as a general image printing apparatus.

For the purpose of accurate recording of an image, heads need to be positioned relative to a recording medium, which is to be conveyed, and mounted on an inkjet recording apparatus with high accuracy.

The inkjet recording apparatus includes droplet-discharging heads (line heads) in which a plurality of short heads (head modules) having the length of a nozzle array, which is shorter than the width of a recording medium, are joined so as to extend in a main scanning direction, in order to achieve the high-speed recording of an image.

Incidentally, gaps are formed on the nozzle surfaces of the droplet-discharging head in which the plurality of head modules are joined as described above, due to the structure of the droplet-discharging head. That is, since the nozzle surfaces of the droplet-discharging head are also formed by the joining of the nozzle surfaces of adjacent head modules, gaps are formed at joints between the head modules. When the gaps are present on the nozzle surfaces, there is a problem in that ink subjected to pressure purging enters the gaps during the pressure purging. Further, when the ink enters the gaps, the ink remains in the gaps and causes the reduction of the life, reliability, and printing performance of the head and staining of the recording medium in the worst case.

JP2005-74767A discloses a structure in which absorbents are disposed so as to enter gaps of nozzle surfaces to effectively absorb ink entering the gaps of the nozzle surfaces.

SUMMARY OF THE INVENTION

In JP2005-74767A, the absorbents are disposed in the gaps of the nozzle surfaces while avoiding openings of nozzles. However, there are problems in that it is very difficult to fit the absorbents into small gaps and the absorbents need to be cleaned since ink (liquid) is accumulated in the absorbents.

The invention has been made in consideration of the above-mentioned circumstances, and an object of the invention is to provide an image printing apparatus that can prevent liquid, which overflows from nozzles in the case where the pressure purging of a droplet-discharging head is performed, from infiltrating into head module gaps.

Means for achieving the above-mentioned object are as follows.

According to a first aspect, there is an image printing apparatus having: a droplet-discharging head in which a plurality of head modules having nozzle surfaces in which a plurality of nozzles discharging liquid are disposed are fixed and joined by head module support members and the nozzle surfaces are inclined with respect to a horizontal plane; a receiving member that receives the liquid discharged from the nozzles in the case where the droplet-discharging head performs pressure purging; and a liquid infiltration-preventing pad that is provided in the receiving member, comes into contact with the droplet-discharging head during the pressure purging, and prevents the liquid, which is discharged by the pressure purging, from infiltrating into gaps between the head modules. The liquid infiltration-preventing pad is made of a non-absorbent material that does not absorb the liquid, and includes a flow passage in which the liquid discharged by the pressure purging is collected by the inclination of the nozzle surfaces. Meanwhile, "the horizontal plane", which has been mentioned here, means a direction orthogonal to the direction of gravity.

The infiltration of the liquid into the gaps between the head modules, which is caused by the pressure purging, has two modes, that is, a mode in which the ink subjected to the pressure purging directly infiltrates and a mode in which the ink flows along gaps between the nozzle surfaces and the head module support members of the head modules. Particularly, in the inkjet head that is provided so that the nozzle surfaces are inclined with respect to the horizontal plane, the ink adhering to the nozzle surfaces enters gaps between the nozzle surfaces and the head module support members due to the flow of the ink that is generated by gravity. The ink, which has entered the gaps between the nozzle surfaces and the head module support members, flows along the gaps between the nozzle surfaces and the head module support members and is likely to infiltrate into head module gaps (gaps between the head modules).

According to this aspect, the liquid infiltration-preventing pad, which prevents the infiltration of the ink during the pressure purging, is provided in the receiving member that receives the liquid discharged from the nozzles in the case where the pressure purging is performed. The liquid infiltration-preventing pad is made of a material that does not absorb the liquid. Further, the liquid infiltration-preventing pad has the flow passage in which the liquid discharged by the pressure purging is collected. That is, since the liquid infiltration-preventing pad is made of a non-absorbent material not absorbing the liquid and has a flow passage in which the liquid discharged by the pressure purging is collected by the inclination of the nozzle surfaces, the ink, which is discharged by the pressure purging, is collected at arbitrary positions of the head module support members. Accordingly, it is possible to prevent the liquid from infiltrating into the gaps between the head modules.

Therefore, the infiltration of the liquid into the gaps between the head modules, which is caused by the pressure purging, is prevented by this aspect, so that long life and reliability of the droplet-discharging head are guaranteed. Meanwhile, since the liquid infiltration-preventing pad of this aspect does not require positioning accuracy, it is possible to very easily close the gaps between the head modules.

According to a second aspect, in the image printing apparatus of the first aspect, the liquid infiltration-preventing pad may be a plurality of pads that have flow passages having gaps which are formed at positions of the head module support members, in which the liquid discharged by the pressure purging is collected, and close gaps between the nozzle surfaces, which are provided on a lower side in a direction of gravity, of the nozzle surfaces, which are inclined with respect to the horizontal plane, and the head module support members by non-flow passages. Meanwhile, "the lower side in the direction of gravity", which has been mentioned here, means the side toward which gravity acts. In contrast, "the upper side in the direction of gravity" means the side opposite to the side toward which gravity acts.

According to this aspect, the liquid infiltration-preventing pad closes the gaps between the nozzle surfaces, which are provided on the lower side in the direction of gravity, of the nozzle surfaces, which are inclined with respect to the horizontal plane, and the head module support members, except for the flow passages that are provided at positions between the head modules. Accordingly, since the liquid, which is discharged by the pressure purging, is collected at arbitrary positions, it is possible to prevent the liquid from infiltrating into the gaps between the head modules.

According to a third aspect, in the image printing apparatus of the first aspect, the liquid infiltration-preventing pad may be a series of pads that close gaps between the nozzle surfaces, which are provided on a lower side in a direction of gravity, of the nozzle surfaces, which are inclined with respect to the horizontal plane, and the head module support members and may have flow passages which are formed on non-contact surfaces of the pads not coming into contact with the droplet-discharging head and in which the liquid discharged by the pressure purging is collected.

Since the liquid infiltration-preventing pad closes all of the gaps between the nozzle surfaces, which are provided on a lower side in a direction of gravity, of the nozzle surfaces, which are inclined with respect to the horizontal plane, and the head module support members and has flow passages in which the liquid discharged by the pressure purging is collected, it is possible to completely prevent the infiltration of the liquid into the gaps between the head modules, which is caused by the mode in which the liquid flows along the gaps between the nozzle surfaces and the head module support members, in contrast to the second aspect.

According to a fourth aspect, in the image printing apparatus of the second or third aspect, an end face, which is provided on the upper side in the direction of gravity with respect to the droplet-discharging head, of the liquid infiltration-preventing pad may be formed to be inclined so that the liquid discharged by the pressure purging is guided to the flow passages.

According to this aspect, the end face, which is provided on the upper side in the direction of gravity, of the liquid infiltration-preventing pad is formed to be inclined. Accordingly, capacity for guiding the liquid to the flow passages is improved.

According to a fifth aspect, in the image printing apparatus of any one of the second to fourth aspects, the liquid infiltration-preventing pad may further have a series of pads that close gaps between the nozzle surfaces, which are provided on an upper side in the direction of gravity, of the nozzle surfaces, which are inclined with respect to the horizontal plane, and the head module support members.

According to this aspect, not only the gaps between the nozzle surfaces, which are provided on a lower side in the direction of gravity, of the nozzle surfaces, which are inclined with respect to the horizontal plane, and the head module support members but also the gaps between the nozzle surfaces, which are provided on an upper side in the direction of gravity, of the nozzle surfaces, which are inclined with respect to the horizontal plane, are closed by the liquid infiltration-preventing pad. Accordingly, it is possible to further prevent the liquid from infiltrating into the gaps between the head modules.

According to a sixth aspect, in the image printing apparatus of any one of the second to fifth aspects, one head module may have two or more flow passages.

According to this aspect, one head module has two or more flow passages. Accordingly, capacity for collecting the ink is improved.

According to a seventh aspect, in the image printing apparatus of any one of the first to sixth aspects, the liquid infiltration-preventing pad may be formed of an elastic body.

According to this aspect, since the liquid infiltration-preventing pad is formed of an elastic body, it is possible to close the gaps between the nozzle surfaces and the head module support members with high sealability. Further, it is also possible to prevent the nozzle surface from being damaged.

According to an eighth aspect, in the image printing apparatus of any one of the first to seventh aspects, an end face of the liquid infiltration-preventing pad may be treated with hydrophilic treatment.

According to this aspect, since the end face of the liquid infiltration-preventing pad is treated with hydrophilic treatment, capacity for collecting the ink is further improved.

According to a ninth aspect, in the image printing apparatus of any one of the first to eighth aspects, the liquid infiltration-preventing pad may be fixed to the receiving member via a support member.

According to a tenth aspect, in the image printing apparatus of any one of the first to ninth aspects, the receiving member may comprise a moisture retention cap that retains moisture of the nozzle surface and the liquid, which is discharged from the nozzles in the case where the pressure purging is performed, may be received in the receiving member.

According to the invention, it is possible to prevent liquid, which overflows from nozzles in the case where the pressure purging of a droplet-discharging head is performed, from infiltrating into head module gaps.

DESCRIPTION OF THE PREFERRED EMBODIMENTS

Preferred embodiments of an image printing apparatus according to the invention will be described below with reference to the accompanying drawings. Meanwhile, an inkjet head will be described below as an example of a droplet-discharging head. Further, an inkjet recording apparatus including inkjet heads will be described.

<<Entire Configuration of Inkjet Recording Apparatus>>

Figure 1:
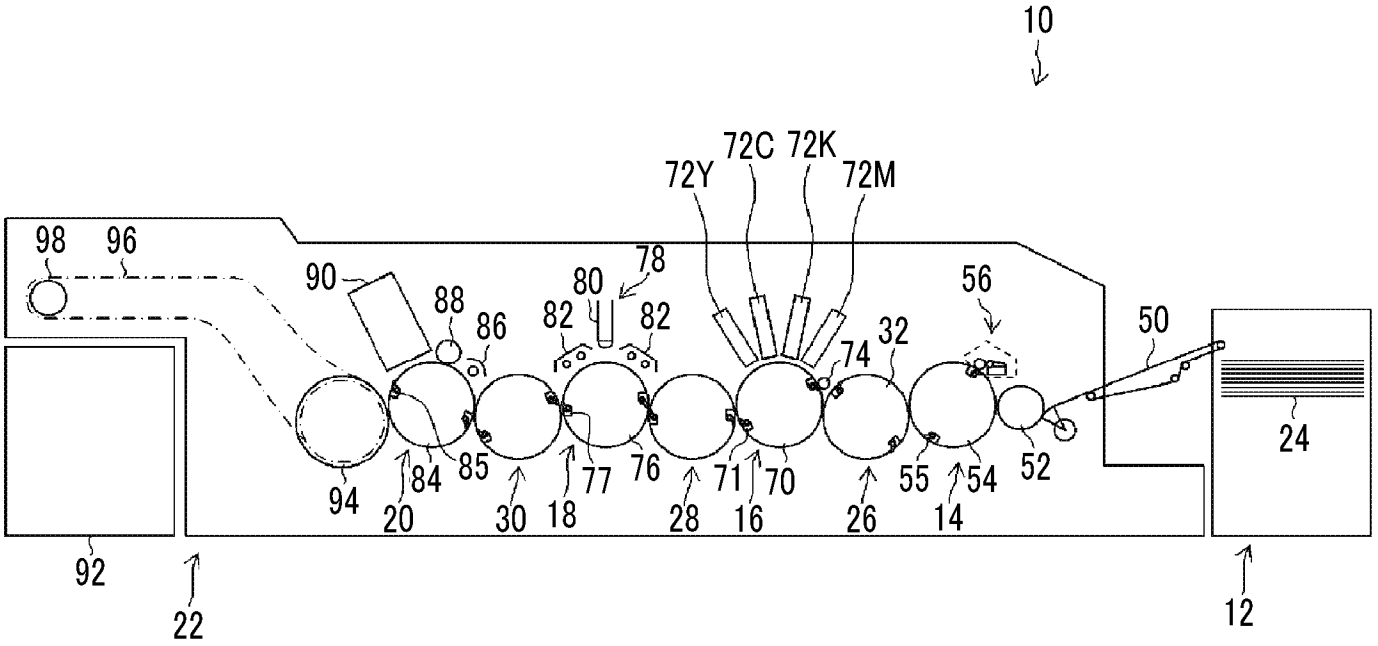
FIG. 1 is a view showing the entire configuration of an inkjet recording apparatus.

First, the entire configuration of an inkjet recording apparatus will be described. FIG. 1 is a view showing the entire configuration of the inkjet recording apparatus.

An inkjet recording apparatus 10 is an impression cylinder-direct drawing type inkjet recording apparatus that forms a desired color image by dropping inks having a plurality of colors on a recording medium 24 (referred to as "a sheet", for convenience), which is held by an impression cylinder (a drawing drum 70) of a drawing section 16, from inkjet heads 72M, 72K, 72C, and 72Y, and is an on-demand type image forming device to which a two-liquid reaction (aggregating) method is applied and which is adapted to apply treatment liquid (here, aggregating-treatment liquid) to the recording medium 24 before dropping inks and to form an image on the recording medium 24 by allowing the treatment liquid and inks to react to each other.

As shown in FIG. 1, the inkjet recording apparatus 10 mainly comprises a sheet feed section 12, a treatment liquid applying section 14, a drawing section 16, a drying section 18, a fixing section 20, and a discharge section 22.

(Sheet Feed Section)

The sheet feed section 12 is a mechanism that feeds a recording medium 24 to the treatment liquid applying section 14, and recording media 24, which are paper sheets, are stacked in the sheet feed section 12. The sheet feed section 12 is provided with a sheet feed tray 50, and the recording media 24 are fed one by one to the treatment liquid applying section 14 from the sheet feed tray 50.

In the inkjet recording apparatus 10 of this embodiment, a plurality of kinds of recording media 24 having different types or sizes (sheet sizes) can be used as the recording media 24. The sheet feed section 12 may comprise a plurality of sheet trays (not shown) on which various recording media are classified and stacked, and sheets fed to the sheet feed tray 50 from these sheet trays may be automatically switched and an operator may select a sheet tray as necessary or replace a sheet tray. Meanwhile, paper sheets (cut sheets) are used as the recording media 24 in this embodiment, but a continuous sheet (a rolled sheet) may be cut into a desired size and the cut sheets may be fed.

(Treatment Liquid Applying Section)

The treatment liquid applying section 14 is a mechanism that applies treatment liquid to the recording surface of the recording medium 24. Since the treatment liquid contains a color material aggregating agent for aggregating a color material (a pigment in this embodiment) of the ink that is applied in the drawing section 16, the separation of the ink into a color material and a solvent is facilitated by the contact between the treatment liquid and the ink.

As shown in FIG. 1, the treatment liquid applying section 14 comprises a sheet feed cylinder 52, a treatment liquid drum 54, and a treatment liquid applying device 56. The treatment liquid drum 54 is a drum that holds a recording medium 24 and conveys the recording medium 24 by being rotated. The treatment liquid drum 54 comprises claw-shaped holding means (grippers) 55 on the outer peripheral surface thereof, and is adapted to be capable of holding the end of the recording medium 24 by making the recording medium 24 be interposed between claws of the holding means 55 and the peripheral surface of the treatment liquid drum 54. Suction holes may be formed at the outer peripheral surface of the treatment liquid drum 54 and suction means for performing section from the suction holes may be connected to the treatment liquid drum 54. Accordingly, it is possible to closely hold a recording medium 24 on the peripheral surface of the treatment liquid drum 54.

The treatment liquid applying device 56 is provided outside the treatment liquid drum 54 so as to face the peripheral surface of the treatment liquid drum 54. The treatment liquid applying device 56 includes a treatment liquid container in which treatment liquid is stored, an anilox roller of which a part is immersed in the treatment liquid of the treatment liquid container, and a rubber roller that comes into pressure contact with the anilox roller and the recording medium 24 held on the treatment liquid drum 54 and transfers measured treatment liquid to the recording medium 24. According to the treatment liquid applying device 56, it is possible to apply treatment liquid to the recording medium 24 while measuring the treatment liquid.

The recording medium 24, to which the treatment liquid has been applied by the treatment liquid applying section 14, is delivered to the drawing drum 70 of the drawing section 16 from the treatment liquid drum 54 through an intermediate conveying section 26.

(Drawing Section)

The drawing section 16 comprises the drawing drum (a second conveyance body) 70, a sheet pressing roller 74, and inkjet heads 72M, 72K, 72C, and 72Y. The drawing drum 70 comprises claw-shaped holding means (grippers) 71 on the outer peripheral surface thereof as in the case of the treatment liquid drum 54. The recording medium 24 fixed to the drawing drum 70 is conveyed while the recording surface of the recording medium 24 faces the outside, and inks are applied to the recording surface from the inkjet heads 72M, 72K, 72C, and 72Y.

It is preferable that each of the inkjet heads 72M, 72K, 72C, and 72Y is a full-line type inkjet recording head (an inkjet head) having a length corresponding to the maximum width of an image forming area of the recording medium 24. A nozzle array, in which a plurality of ink discharge nozzles are arranged over the entire width of the image forming area, is formed on an ink discharge surface. Each of the inkjet heads 72M, 72K, 72C, and 72Y is installed so as to extend in a direction orthogonal to the conveying direction of the recording medium 24 (the rotation direction of the drawing drum 70).

In the case where droplets of corresponding color inks are discharged toward the recording surface of the recording medium 24, which is closely held on the drawing drum 70, from the respective inkjet heads 72M, 72K, 72C, and 72Y, the inks come into contact with the treatment liquid applied to the recording surface in advance by the treatment liquid applying section 14 and color materials (pigments) dispersed in the inks are aggregated. As a result, color material aggregates are formed. Accordingly, the flows of the color materials or the like on the recording medium 24 are prevented, so that an image is formed on the recording surface of the recording medium 24.

Meanwhile, the configuration of standard colors (four colors) of CMYK has been described in this embodiment, but the combinations of the colors of inks or the number of colors are not limited to this embodiment and a thin ink, a thick ink, and a specific color ink may be added as necessary. For example, an inkjet head, which discharges an ink having a light color, such as light cyan or light magenta, may be added, and the arrangement order of the respective color heads is also not particularly limited.

The recording medium 24 on which an image has been formed by the drawing section 16 is delivered to a drying drum 76 of the drying section 18 from the drawing drum 70 through an intermediate conveying section 28.

(Drying Section)

The drying section 18 is a mechanism that removes moisture contained in the solvent separated by a color material aggregation action, and comprises the drying drum 76 and a solvent drying device 78 as shown in FIG. 1.

The drying drum 76 comprises claw-shaped holding means (grippers) 77 on the outer peripheral surface thereof as in the case of the treatment liquid drum 54, and is adapted to be capable of holding the end of the recording medium 24 by the holding means 77.

The solvent drying device 78 is disposed so as to face the outer peripheral surface of the drying drum 76, and includes a plurality of IR heaters 82 and hot-air ejection nozzles 80 that are disposed between the respective IR heaters 82.

It is possible to achieve various drying conditions by appropriately adjusting the temperature and the amount of heat of hot air, which is blown toward the recording medium 24 from the respective hot-air ejection nozzles 80, and the temperatures of the respective IR heaters 82.

Further, the surface temperature of the drying drum 76 is set to 50° C. or more. Heating is performed from the back of the recording medium 24, so that drying is facilitated. Accordingly, it is possible to prevent the destruction of an image during the fixing of the image. Meanwhile, the upper limit of the surface temperature of the drying drum 76 is not particularly limited, but is preferably set to 75° C. or less (more preferably set to 60° C. or less) in terms of the safety (the prevention of burns caused by high temperature) of maintenance such as the cleaning of the ink adhering to the surface of the drying drum 76.

The recording medium 24 is held on the outer peripheral surface of the drying drum 76 so as to allow the recording surface of the recording medium 24 to face the outside (that is, in a state in which the recording medium 24 is curved so that the recording surface of the recording medium 24 becomes a convex side) and is dried while the drying drum conveys the recording medium 24 by being rotated. Accordingly, it is possible to prevent the recording medium 24 from wrinkling and floating and to reliably prevent the non-uniform drying of the recording medium that is caused by the wrinkles and floating of the recording medium 24.

The recording medium 24, which has been dried by the drying section 18, is delivered to a fixing drum 84 of the fixing section 20 from the drying drum 76 through an intermediate conveying section 30.

(Fixing Section)

The fixing section 20 includes the fixing drum 84, a halogen heater 86, a fixing roller 88, and an in-line sensor 90. The fixing drum 84 comprises claw-shaped holding means (grippers) 85 on the outer peripheral surface thereof as in the case of the treatment liquid drum 54, and is adapted to be capable of holding the end of the recording medium 24 by the holding means 85.

The recording medium 24 is conveyed by the rotation of the fixing drum 84 while the recording surface of the recording medium faces the outside. Preheating performed by the halogen heater 86, fixing performed by the fixing roller 88, and inspection performed by the in-line sensor 90 are performed on the recording surface.

The halogen heater 86 is controlled at a predetermined temperature (for example, 180° C.). Accordingly, the preheating of the recording medium 24 is performed.

The fixing roller 88 is a roller member that melts and attaches self-dispersible thermoplastic resin fine particles contained in the inks to the recording medium 24 by heating and pressing the dried inks and forms a film with the inks. The fixing roller 88 is adapted to heat and press the recording medium 24. Specifically, the fixing roller 88 is disposed so as to come into pressure contact with the fixing drum 84 and forms a nip roller between the fixing drum 84 and itself. Accordingly, the recording medium 24 is interposed between the fixing roller 88 and the fixing drum 84, is nipped at a predetermined nip pressure (for example, 0.15 MPa), and is subjected to the fixing of an image.

Further, the fixing roller 88 is formed of a heating roller where a halogen lamp is assembled in a metal pipe made of aluminum or the like having high thermal conductivity, and is controlled at a predetermined temperature (for example, 60 to 80° C.). Since the recording medium 24 is heated by the heating roller, thermal energy corresponding to a temperature equal to or higher than Tg temperature (glass-transition temperature) of the thermoplastic resin fine particles contained in the inks is applied to the recording medium 24 and the thermoplastic resin fine particles are melted. Accordingly, pressure fixing is performed on the uneven portion of the recording medium 24 and the uneven portion of the surface of an image is leveled, so that gloss is obtained.

Meanwhile, only one fixing roller 88 is provided in the embodiment of FIG. 1, but fixing rollers may be provided in a plurality of stages according to the thickness of the image or the Tg characteristics of the thermoplastic resin fine particles.

Meanwhile, the in-line sensor 90 is measuring means for measuring check patterns or the amount of moisture, the surface temperature, the gloss level, and the like of the image fixed to the recording medium 24. A CCD line sensor or the like is applied as the in-line sensor 90.

According to the fixing section 20 having the above-mentioned configuration, the thermoplastic resin fine particles in a thin image layer formed by the drying section 18 are heated and pressed by the fixing roller 88, so that the thermoplastic resin fine particles are melted. Accordingly, it is possible to fix an image to the recording medium 24. Further, in the case where the surface temperature of the fixing drum 84 is set to 50° C. or more, the recording medium 24 held on the outer peripheral surface of the fixing drum 84 is heated from the back thereof, so that drying is facilitated. Accordingly, it is possible to prevent the destruction of an image during the fixing of the image and to increase the strength of an image by an effect of raising the temperature of the image.

Furthermore, in the case where the fixing section including a UV irradiation lamp irradiates an image with UV after moisture is sufficiently evaporated by the drying section in a case in which UV curable monomers are contained in the ink, the UV curable monomers are cured and polymerized. Accordingly, it is possible to improve the strength of the image.

(Discharge Section)

As shown in FIG. 1, the discharge section 22 is provided so as to be continued to the fixing section 20. The discharge section 22 comprises a discharge tray 92. A transfer cylinder 94, a conveying belt 96, and a stretching roller 98 are provided between the discharge tray 92 and the fixing drum 84 of the fixing section 20 so as to face and come into contact with the discharge tray 92 and the fixing drum 84. The recording medium 24 is sent to the conveying belt 96 by the transfer cylinder 94, and is discharged to the discharge tray 92.

Further, although not shown in FIG. 1, the inkjet recording apparatus 10 of this embodiment comprises an ink storing/loading section that supplies inks to the respective inkjet heads 72M, 72K, 72C, and 72Y; means for supplying treatment liquid to the treatment liquid applying section 14; a head maintenance section that performs the cleaning (wiping of nozzle surfaces, purge, suction of nozzles, or the like) of the respective inkjet heads 72M, 72K, 72C, and 72Y; a position detecting sensor that detects the position of the recording medium 24 on a sheet conveying path; and a temperature sensor that detects the temperature of each section of the apparatus; and the like, other than the above-mentioned structures.

<Head>

Figure 2:
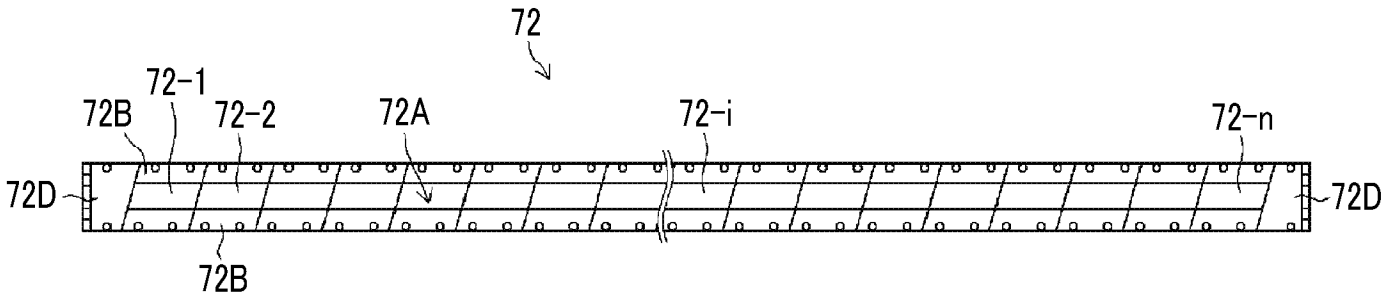
FIG. 2 is a plan view showing an example of the configuration of an inkjet head shown in FIG. 1.

FIG. 2 is a plan view showing an example of the structure of the inkjet head 72, and is a view of the inkjet head 72 that is viewed from a nozzle surface 72A. Furthermore, FIG. 3 is an enlarged view of a part of FIG. 2.

As shown in FIG. 2, the inkjet head 72 has a structure in which n head modules 72-*i*(i=1, 2, 3, . . . , n) are joined in a longitudinal direction (a direction orthogonal to the conveying direction of the recording medium 24 (see FIG. 1)), and a plurality of nozzles (not shown in FIG. 2) are provided on the inkjet head over a length corresponding to the entire width of the recording medium.

Each head module 72-*i* is supported from both sides of the inkjet head 72 in a lateral direction by a head module support member 72B. Further, both end portions of the inkjet head 72 in the longitudinal direction are supported by head support members 72D.

Figure 3:
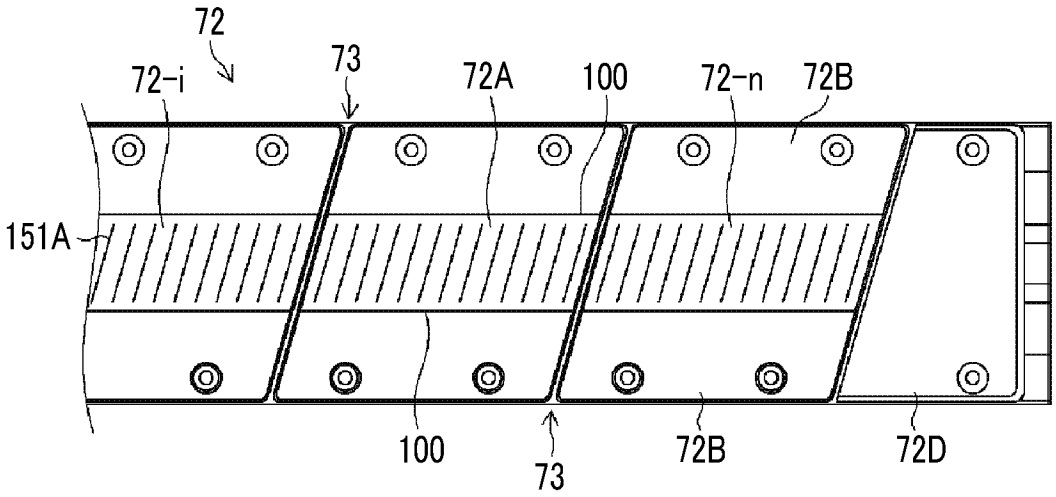
FIG. 3 is an enlarged view of a part of FIG. 2.

As shown in FIG. 3, each head module 72-*i* (n-th head module 72-*n*) has a structure in which a plurality of nozzles are arranged in the form of a matrix. An oblique solid line, which is shown in FIG. 3 and denoted by reference numeral 151A, means a nozzle array in which a plurality of nozzles are arranged in line.

Figure 4A:
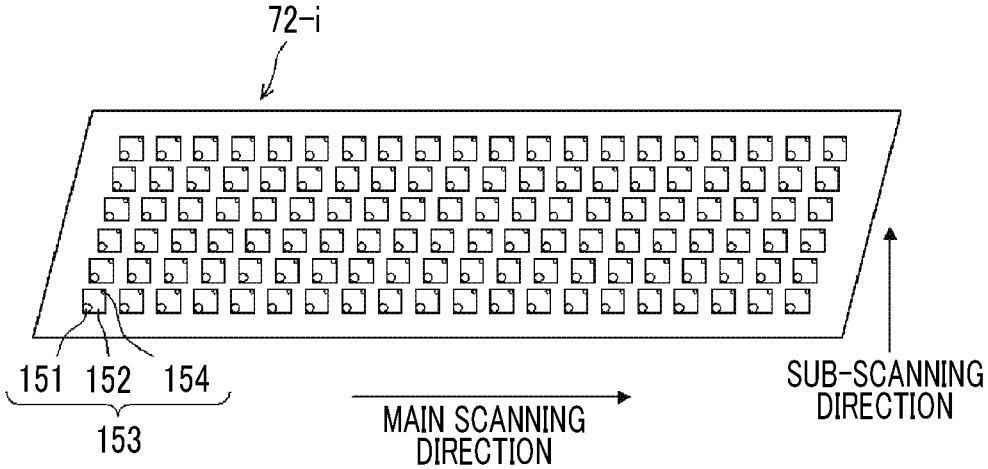
FIGS. 4A and 4B are plan projection views of a head module shown in FIG. 2.
Figure 4B:
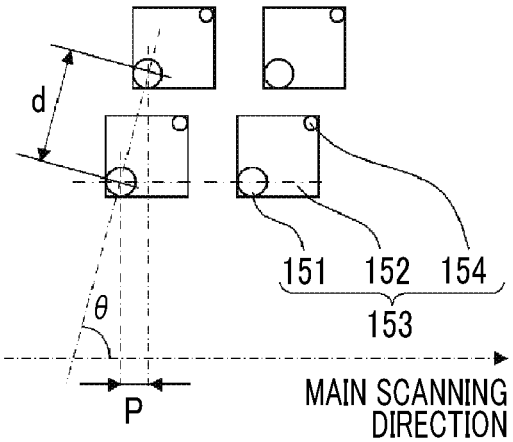

FIG. 4A is a plan projection view of the head module 72-*i*, and FIG. 4B is an enlarged view of a part of FIG. 4A.

It is necessary to reduce of the pitch of the nozzles of the inkjet head 72 in order to reduce of the pitch of dots formed on the recording medium 24. As shown in FIGS. 4A and 4B, the head module 72-*i* of this embodiment has a structure in which a plurality of ink chamber units (droplet-discharging elements as recording element units) 153, each of which has a nozzle 151 as an ink discharge port and a pressure chamber 152 corresponding to the nozzle 151, are disposed in the form of a matrix in a zigzag pattern (two-dimensionally). Accordingly, a substantial interval between the nozzles, which are projected so as to be arranged in the longitudinal direction of the head (a direction orthogonal to the conveying direction of the recording medium 24; a main scanning direction), (a projected nozzle pitch) is reduced.

The planar shape of the pressure chamber 152, which is provided so as to correspond to each nozzle 151, is a substantially square shape. The nozzle 151 is provided at one of both corners of the pressure chamber positioned on the diagonal of the pressure chamber, and a supply port 154 is provided at the other thereof. Meanwhile, the shape of the pressure chamber 152 is not limited to this embodiment, and the planar shape of the pressure chamber may be various shapes, such as a quadrangular shape (a rhombic shape, a rectangular shape, or the like), a pentagonal shape, a hexagonal shape, other polygonal shapes, a circular shape, an elliptical shape, and the like.

As shown in FIG. 4B, a plurality of ink chamber units 153 having such a structure are arranged in the form of a lattice so as to have a certain arrangement pattern in a row direction that is parallel to the main scanning direction and an oblique column direction that has a certain angle θ with respect to the main scanning direction without being orthogonal to the main scanning direction. Accordingly, a dense-nozzle head of this embodiment is realized.

That is, due to a structure in which the plurality of ink chamber units 153 are arranged at a certain pitch d in a direction having an angle θ with respect to the main scanning direction, the pitch P of the nozzles, which are projected so as to be arranged in the main scanning direction, is d×cos θ. Accordingly, the structure can be treated so as to be equivalent to a structure in which the respective nozzles 151 are linearly arranged at a certain pitch P in the main scanning direction. According to this configuration, it is possible to realize a dense-nozzle structure in which the number of nozzle arrays projected so as to be arranged in the main scanning direction reaches 2400 per inch (2400 nozzle/inch).

<<Description of Maintenance Section>>

Figure 5:
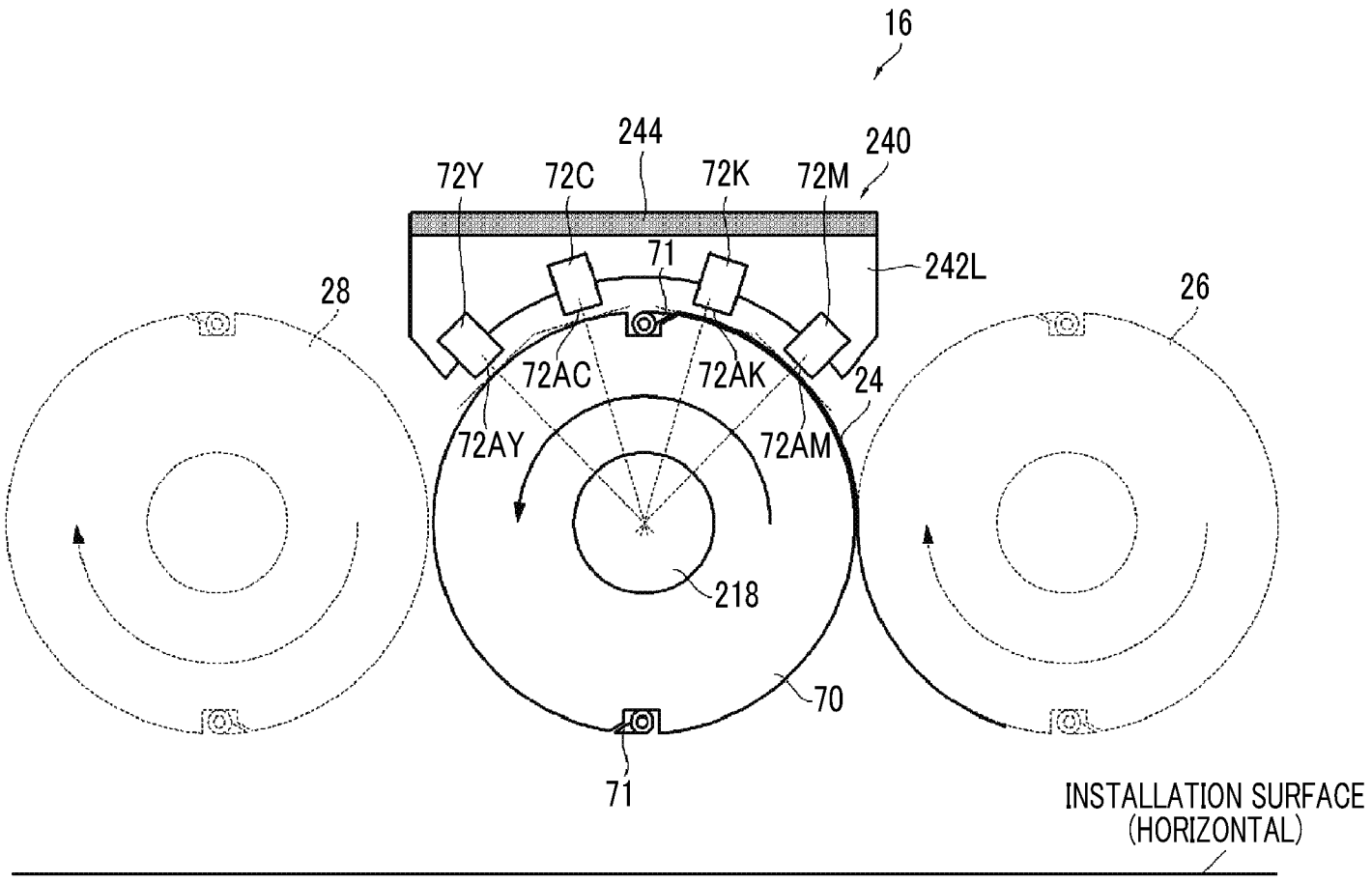
FIG. 5 is a side view of a drawing section of the inkjet recording apparatus.

Next, a maintenance section will be described. FIG. 5 is a side view of the drawing section of the inkjet recording apparatus, FIG. 6 is a front view showing the drawing section of the inkjet recording apparatus, and FIG. 7 is a top view showing the schematic configuration of the drawing section of the inkjet recording apparatus.

Figure 6:
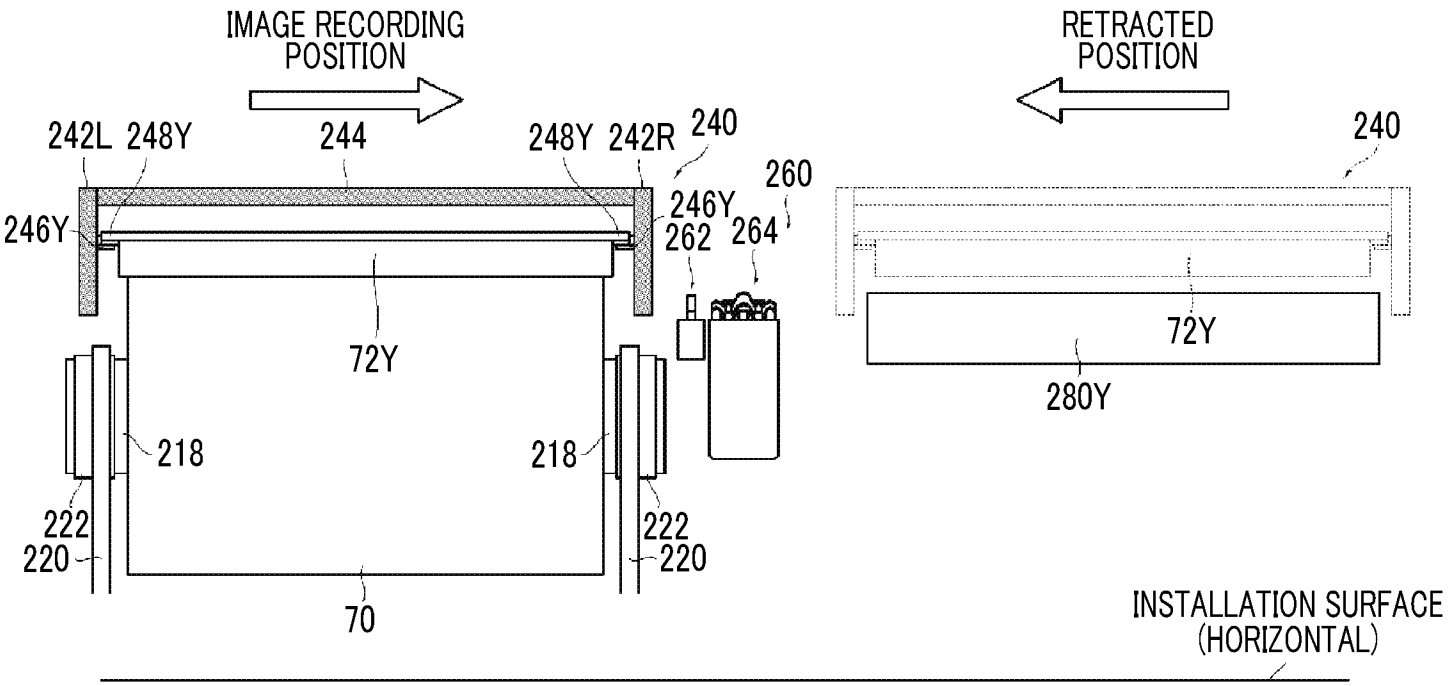
FIG. 6 is a front view showing the drawing section of the inkjet recording apparatus.
Figure 7:
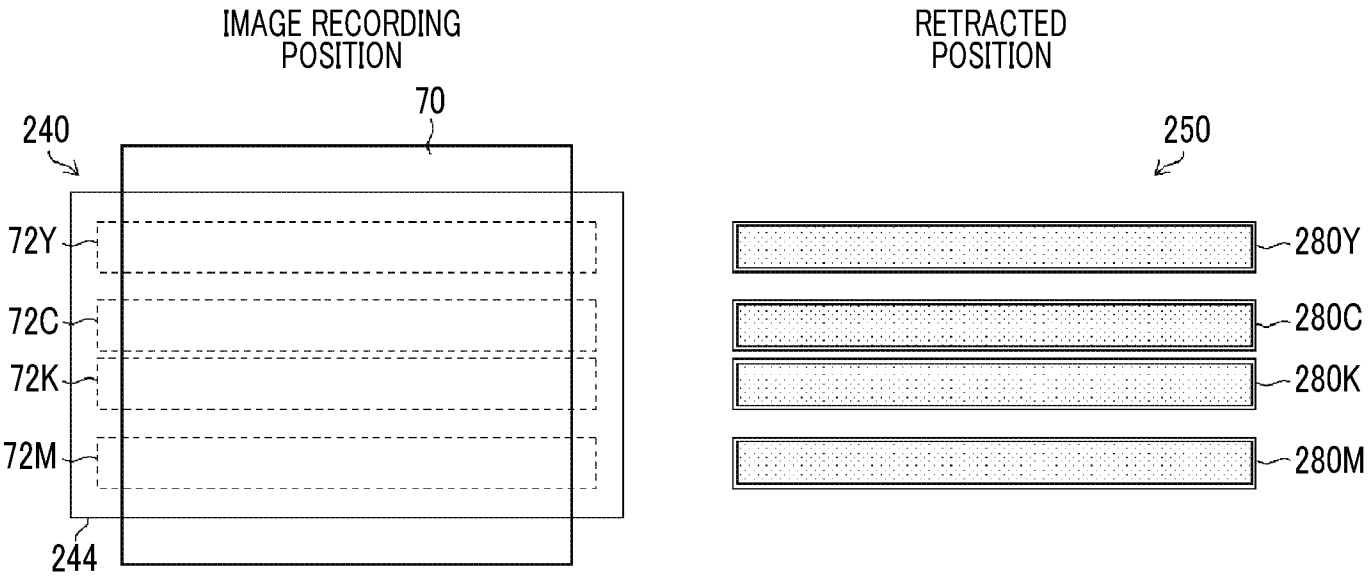
FIG. 7 is a top view showing a schematic configuration of the drawing section of the inkjet recording apparatus.

Both end portions of a rotating shaft 218 of the drawing drum 70 are supported by a pair of bearings 222, so that the drawing drum 70 is rotatably provided (see FIG. 6). Since the pair of bearings 222 are provided on a body frame 220 of the inkjet recording apparatus, the drawing drum 70 is horizontally mounted (the rotating shaft 218 is mounted in parallel to a horizontal installation surface) in the case where both the end portions of the rotating shaft 218 are supported by the pair of bearings 222.

The four inkjet heads 72M, 72K, 72C, and 72Y are radially disposed on a concentric circle, which has a center on the rotating shaft 218 of the drawing drum 70, at regular intervals, and are mounted on a head support frame 240 as shown in FIG. 6 so as to be disposed around the drawing drum 70.

The head support frame 240 includes a pair of side plates 242L and 242R that are provided so as to be orthogonal to the rotating shaft 218 of the drawing drum 70, and a connecting frame 244 that connects upper end portions of the pair of side plates 242L and 242R.

The pair of side plates 242L and 242R are formed in the shape of a plate and are disposed so as to face each other with the drawing drum 70 interposed therebetween. Mounting portions 246M, 246K, 246C, and 246Y, which are used to mount the respective inkjet heads 72M, 72K, 72C, and 72Y, are provided inside the pair of side plates 242L and 242R (for convenience, only the mounting portions 246Y are shown in FIG. 6).

The mounting portions 246C, 246M, 246Y, and 246K are radially disposed on a concentric circle, which has a center on the rotating shaft 218 of the drawing drum 70, at regular intervals. Mounted portions 248M, 248K, 248C, and 248Y (for convenience, only the mounting portions 248Y are shown in FIG. 6), which are formed at both ends of the respective inkjet heads 72M, 72K, 72C, and 72Y, are fixed to the mounting portions 246M, 246K, 246C, and 246Y, so that the inkjet heads 72M, 72K, 72C, and 72Y are mounted on the head support frame 240. Further, the respective inkjet heads 72M, 72K, 72C, and 72Y are radially disposed on a concentric circle, which has a center on the rotating shaft 218 of the drawing drum 70, at regular intervals by being mounted on the head support frame 240.

The head support frame 240 is provided so as to be guided by a guide rail (not shown) and so as to be movable in parallel to the rotating shaft 218 of the drawing drum 70. Furthermore, the head support frame 240 is moved between "an image recording position", which is shown in FIG. 6 by a solid line, and "a retracted position (a maintenance position)", which is shown in FIG. 6 by a broken line, by being driven by a linear drive mechanism (for example, a feed screw mechanism or the like) (not shown).

In the case where the head support frame 240 is positioned at the image recording position, the respective inkjet heads 72M, 72K, 72C, and 72Y are disposed around the drawing drum 70 and are in a state in which the inkjet heads 72M, 72K, 72C, and 72Y can record an image.

The retracted position is set to a position where each of the inkjet heads 72M, 72K, 72C, and 72Y is retracted from the drawing drum 70. A maintenance unit 250, which is used to perform the maintenance of each of the inkjet heads 72M, 72K, 72C, and 72Y, is provided at the retracted position.

The maintenance unit 250 is provided with receiving members (caps) 280M, 280K, 280C, and 280Y (for convenience, only the receiving member 280Y is shown in FIG. 6) that cover the nozzle surfaces of the respective inkjet heads 72M, 72K, 72C, and 72Y. In a case in which the apparatus is stopped for a long time, the nozzle surfaces are covered with the receiving members 280M, 280K, 280C, and 280Y. Accordingly, a discharge failure caused by drying is prevented.

Meanwhile, each of the receiving members 280M, 280K, 280C, and 280Y is provided with a pressurization/suction mechanism (not shown), and is adapted so that the inside of the nozzles can be pressurized and sucked.

Further, each of the receiving members 280M, 280K, 280C, and 280Y is provided with a cleaning solution supply mechanism (not shown), and is adapted so that a cleaning solution can be supplied into each receiving member.

Figure 8:
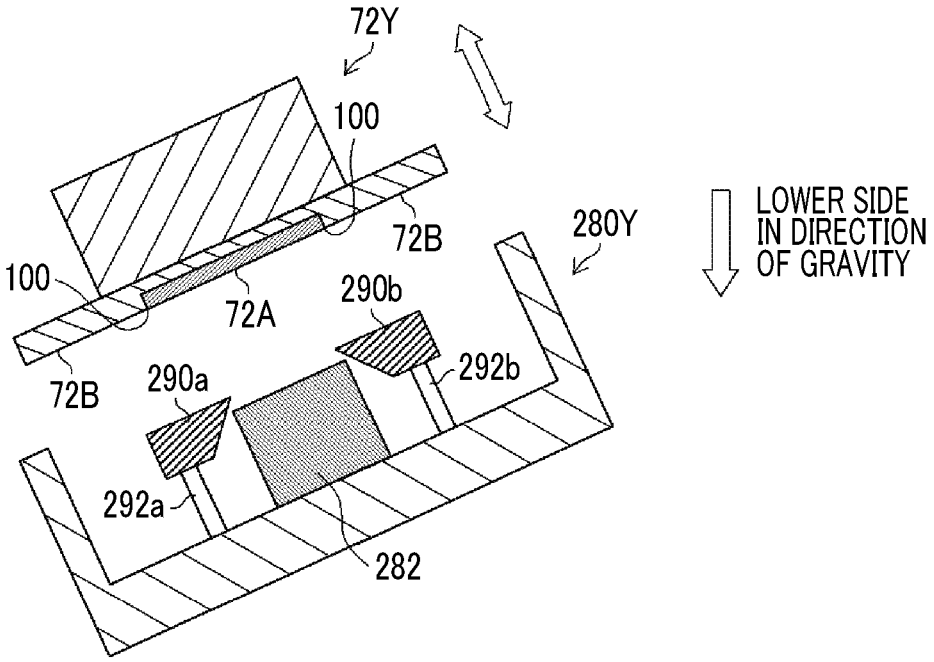
FIG. 8 is a side cross-sectional view showing the inkjet head and a receiving member.
Figure 9:
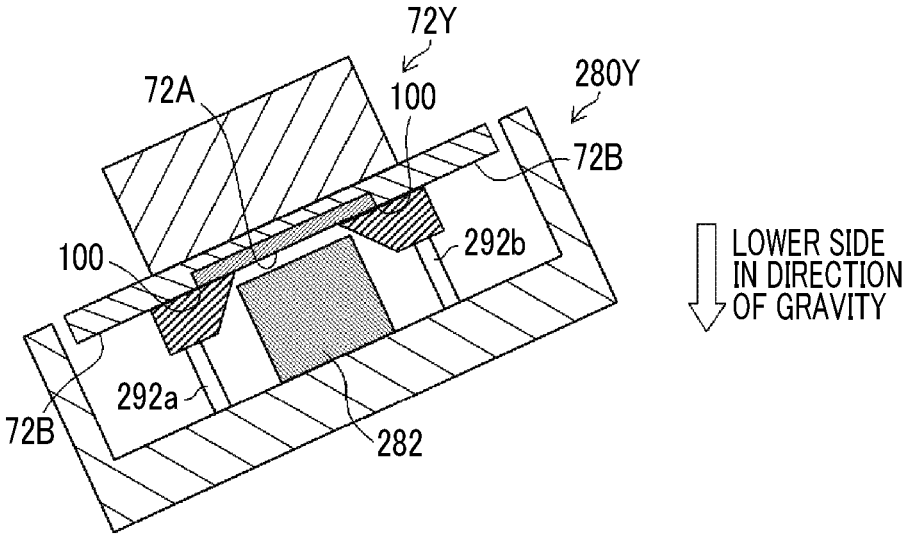
FIG. 9 is a side cross-sectional view showing the inkjet head and the receiving member.
Figure 10:
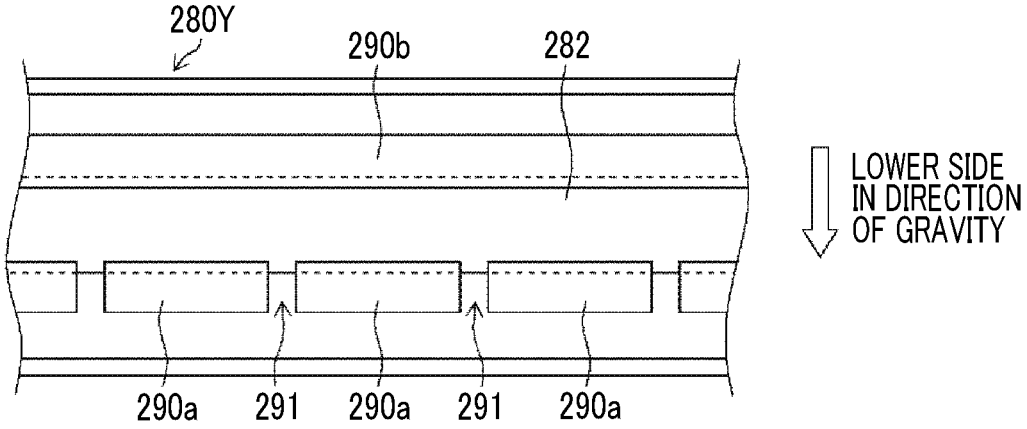
FIG. 10 is a top view of the receiving member that is viewed from the top.

FIGS. 8 and 9 are side cross-sectional views showing the inkjet head 72Y and the receiving member 280Y. Meanwhile, FIG. 10 is an example of a view of the receiving member 280Y of FIGS. 8 and 9 that is viewed from the top.

The receiving member 280Y is provided with a moisture retention cap 282. Moisturizing liquid is supplied to the moisture retention cap 282 (not shown). The inkjet head 72Y is adapted to move up and down at the retracted position.

The moisture retention cap 282 is a member that covers the nozzle surface 72A of the inkjet head 72Y to cap the inkjet head 72Y. In the case where the inkjet recording apparatus 10 is not used for a long time, the nozzle surface 72A of the inkjet head 72Y is covered with the moisture retention cap 282 as shown in FIG. 9. Accordingly, it is possible to prevent a solvent from being evaporated from the nozzles and to prevent foreign materials from adhering to the nozzle surface 72A. Meanwhile, for example, pure water is used as the moisturizing liquid.

In a case in which pressure purging is performed, the inside of the head is pressurized in a state in which the nozzle surface 72A of the inkjet head 72Y is covered with the moisture retention cap 282, so that an ink is discharged from the nozzles. Accordingly, ink subjected to purge can be collected by the moisture retention cap 282.

Meanwhile, although not shown, the moisture retention cap is provided with a moisturizing liquid supply device that supplies moisturizing liquid, a waste liquid device that discards moisturizing liquid or the like present in the moisture retention cap, and the like.

Here, in the case where the ink is subjected to pressure purging as described above, an ink is likely to infiltrate into a gap between the head modules. As shown in FIG. 5, the four inkjet heads 72M, 72K, 72C, and 72Y are provided so that the nozzle surfaces of the four inkjet heads 72M, 72K, 72C, and 72Y are inclined with respect to the horizontal plane.

Figure 11:
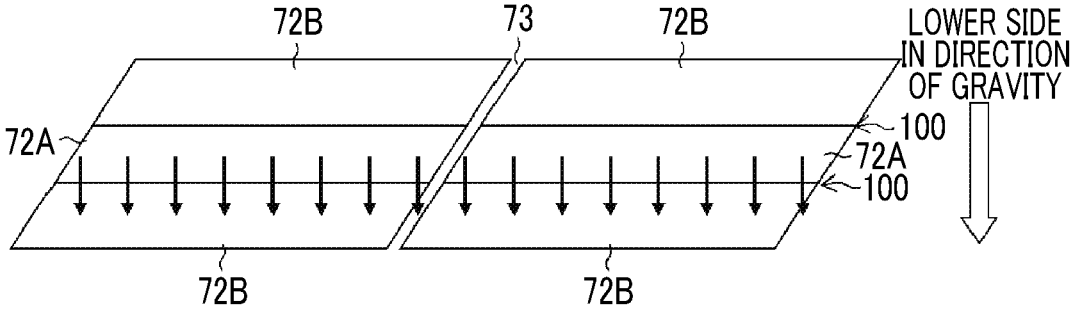
FIG. 11 is a view showing a mode in which an ink subjected to pressure purging directly infiltrates.
Figure 12:
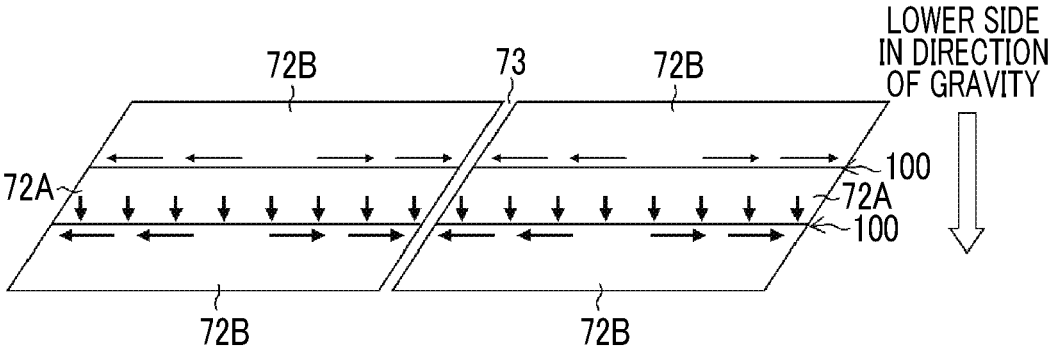
FIG. 12 is a view showing a mode in which an ink subjected to pressure purging flows along gaps between nozzle surfaces and head module support members.

The infiltration of an ink into a gap between the head modules, which is caused by pressure purging, has two modes, that is, a mode in which the ink subjected to pressure purging directly infiltrates as shown in FIG. 11, and a mode in which an ink flows along gaps 100 between the nozzle surfaces 72A and the head module support members 72B of the head modules as shown in FIG. 12. Particularly, in the inkjet head that is provided so that the nozzle surface is inclined with respect to the horizontal plane as shown in FIG. 5, the ink adhering to the nozzle surface enters gaps between the nozzle surfaces and the head module support members due to the flow of the ink that is generated by gravity. The ink, which has entered the gap between the nozzle surface 72A and the head module support member 72B, flows along the gap between the nozzle surface 72A and the head module support member 72B and is likely to infiltrate into gaps 73 between the head modules. Meanwhile, here, "the nozzle surface is inclined with respect to the horizontal plane" means that the nozzle surface is not parallel to the horizontal plane and is inclined with respect to the horizontal plane by an angle in the range of 1° to 89°.

Accordingly, in order to prevent the ink, which adheres to the nozzle surface 72A, from entering a gap between the nozzle surface 72A and the head module support member 72B due to the flow of the ink that is generated by gravity since the nozzle surface 72A is inclined, liquid infiltration-preventing pads 290*a* and 290*b*, which prevent the ink from infiltrating into a gap between the head modules, are provided as shown in FIGS. 8 and 9.

Meanwhile, the liquid infiltration-preventing pads 290*a* and 290*b* need to be provided without closing the nozzles 151 of the nozzle surface 72A.

FIG. 10 is a view of the receiving member 280Y of FIGS. 8 and 9 that is viewed from the top, and is a top view of the receiving member that comprises the liquid infiltration-preventing pads 290*a* and 290*b*. Further, FIGS. 13 and 14 show the head module 72-*i* and the liquid infiltration-preventing pads 290*a* and 290*b*, FIG. 13 is a bottom view of the head modules 72-*i* and the liquid infiltration-preventing pads 290*a* and 290*b* that are viewed from below, and FIG. 14 is a cross-sectional view taken along line 14-14 of FIG. 13.

The droplet-discharging head 72Y is provided so that the nozzle surface 72A is inclined with respect to the horizontal plane. The receiving member 280Y, which receives an ink in the case where the pressure purging of the droplet-discharging head 72Y is performed, is provided in parallel to the nozzle surface 72A. That is, the receiving member 280Y is inclined with respect to the horizontal plane as in the case of the nozzle surface 72A.

Here, the receiving member 280Y is inclined so that the liquid infiltration-preventing pads 290*a* are provided on the lower side in the direction of gravity and the liquid infiltration-preventing pad 290*b* is provided on the upper side in the direction of gravity in the case where the receiving member 280Y is inclined with respect to the horizontal plane. The liquid infiltration-preventing pads 290*a* and 290*b* are fixed to the receiving member 280Y through support members 292*a* and 292*b*. Since the support members 292*a* and 292*b* should make the liquid infiltration-preventing pads 290*a* and 290*b* come into close contact with the droplet-discharging head 72Y with no gap as shown in FIG. 9, it is preferable that the support members 292*a* and 292*b* are members having a restoring force like springs and pressing the liquid infiltration-preventing pads 290*a* and 290*b* against the droplet-discharging head 72Y.

Figure 13:
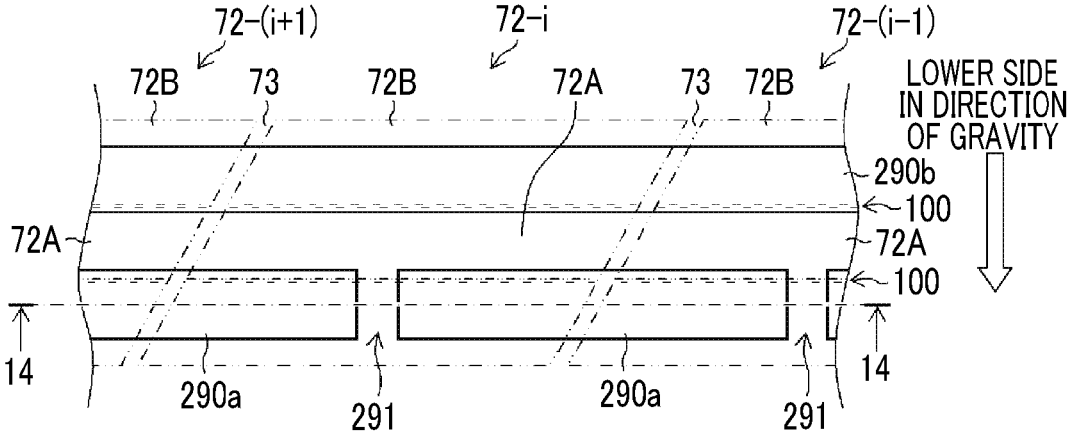
FIG. 13 is a view showing head modules and liquid infiltration-preventing pads.
Figure 14:
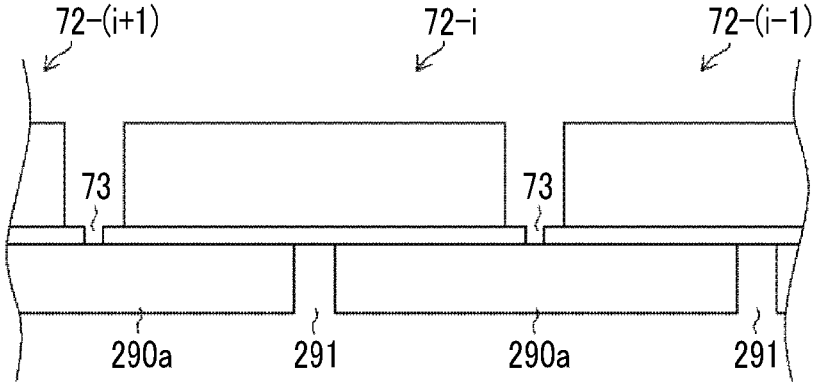
FIG. 14 is a cross-sectional view taken along line 14-14 of FIG. 13.

In the embodiment of FIGS. 10, 13, and 14, the moisture retention cap 282 is provided in the receiving member 280Y and the moisture retention cap 282 covers the nozzle surface 72A. Further, in the case where the receiving member 280Y comes into contact with the moisture retention cap 282 and pressure purging is performed, the liquid infiltration-preventing pads 290*a* and 290*b* are provided in the receiving member 280Y so as to close the gaps 100 between the nozzle surfaces 72A and the head module support members 72B.

The liquid infiltration-preventing pads 290*a*, which are provided on the lower side in the direction of gravity, have flow passages 291. That is, the liquid infiltration-preventing pads 290*a*, which are provided on the lower side in the direction of gravity, are a plurality of liquid infiltration-preventing pads that are arranged at intervals. The ink, which adheres to the nozzle surface 72A by pressure purging, is collected at arbitrary positions of the head module support members 72B through the flow passages 291 and is discarded into the receiving member 280Y. Meanwhile, in the case of an aspect in which the infiltration-preventing pads 290*a* provided on the lower side in the direction of gravity are a plurality of pads that are arranged at intervals, the liquid infiltration-preventing pads 290*a* need to be provided so as to have the flow passages 291 at positions that do not correspond to the gaps 73 between the head modules as shown in FIGS. 13 and 14.

The liquid infiltration-preventing pad 290*b*, which is provided on the upper side in the direction of gravity, is one pad that is provided at a position where the pad closes the gaps 100 between the nozzle surfaces 72A and the head module support members 72B. Meanwhile, the liquid infiltration-preventing pad 290*b*, which is provided on the upper side in the direction of gravity, closes the gaps 100 that are formed between the nozzle surfaces 72A and the head module support members 72B on the upper side in the direction of gravity, but it is difficult for the ink, which adheres to the nozzle surface, to flow into the gaps 100, which are provided on the upper side in the direction of gravity, in some cases of the flow of the ink that is generated by gravity. Accordingly, it is preferable that the upstream liquid infiltration-preventing pad 290*b* is provided, but the upstream liquid infiltration-preventing pad 290*b* may not be provided.

Since the head module 72-*i* comes into contact with the liquid infiltration-preventing pads 290*a* and 290*b*, it is preferable that each of the liquid infiltration-preventing pads 290*a* and 290*b* is a flexible material (an elastic body) without damaging the head module 72-*i*. Further, each of the liquid infiltration-preventing pads 290*a* and 290*b* should be a material that does not absorb the ink. Accordingly, it is preferable that, for example, silicone rubber, rubber, other resin materials, and the like are used as the materials of the liquid infiltration-preventing pads 290*a* and 290*b*.

As described above, the liquid infiltration-preventing pads are made of a material not absorbing liquid and have the flow passages that collect the ink discharged by pressure purging. Accordingly, since the ink discharged by pressure purging is collected at arbitrary positions, it is possible to prevent the ink from infiltrating into the gap between the head modules.

Meanwhile, it is preferable that end faces of the liquid infiltration-preventing pads 290*a* are treated with hydrophilic treatment. Since the end face of a portion, which comes into contact with the ink, of the liquid infiltration-preventing pad is treated with hydrophilic treatment, the liquid infiltration-preventing pad has an effect of attracting the ink. Accordingly, capacity for collecting the ink is further improved.

Figure 15:
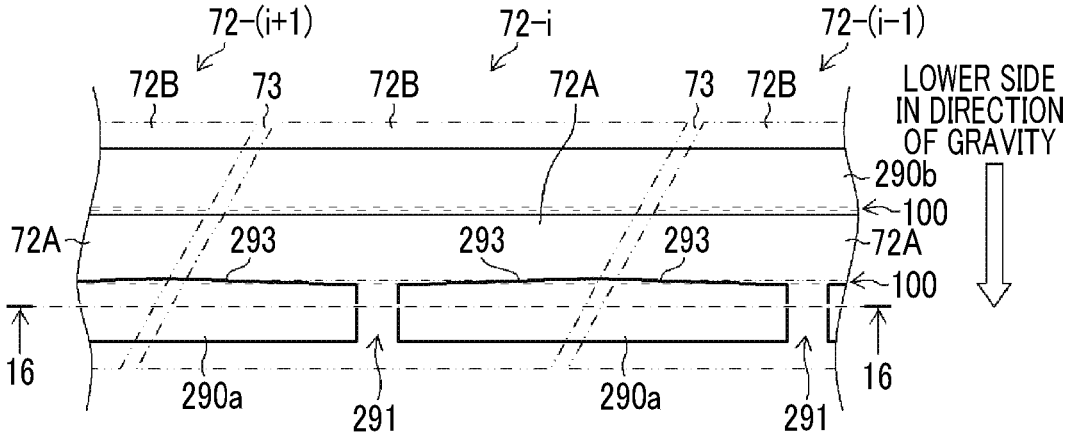
FIG. 15 is a view showing the head modules and liquid infiltration-preventing pads of another aspect.
Figure 16:
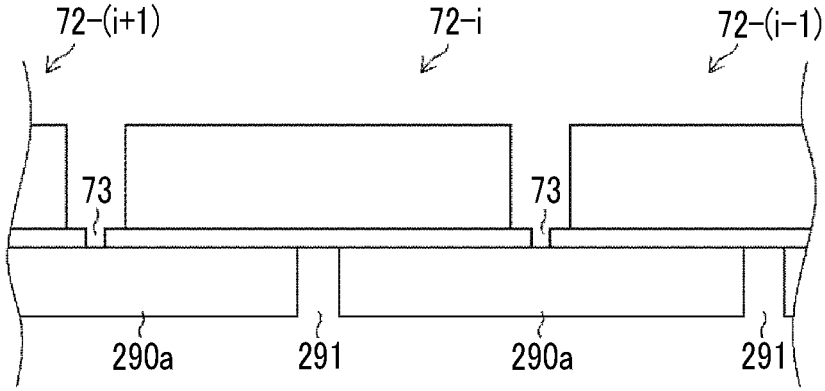
FIG. 16 is a cross-sectional view taken along line 16-16 of FIG. 15.

FIGS. 15 and 16 show a more preferable aspect of the liquid infiltration-preventing pads 290*a* shown in FIGS. 13 and 14. FIG. 15 is a bottom view of the head modules 72-*i* and the liquid infiltration-preventing pads 290*a* and 290*b* that are viewed from below, and FIG. 16 is a cross-sectional view taken along line 16-16 of FIG. 15.

End faces 293, which are provided on the upper side in the direction of gravity in the width direction of the droplet-discharging head, of the liquid infiltration-preventing pads 290*a* shown in FIGS. 15 and 16 are formed so as to be inclined. Meanwhile, the others are the same as those of FIGS. 13 and 14.

Since the end faces 293, which are provided on the upper side in the direction of gravity in the width direction, of the liquid infiltration-preventing pads 290*a* are formed so as to be inclined, capacity for guiding the ink to the flow passages 291 is improved. Accordingly, in the case where the pressure purging of the droplet-discharging head is performed, it is possible to further prevent an ink, which overflows from the nozzles, from infiltrating into a head module gap.

Figure 17:
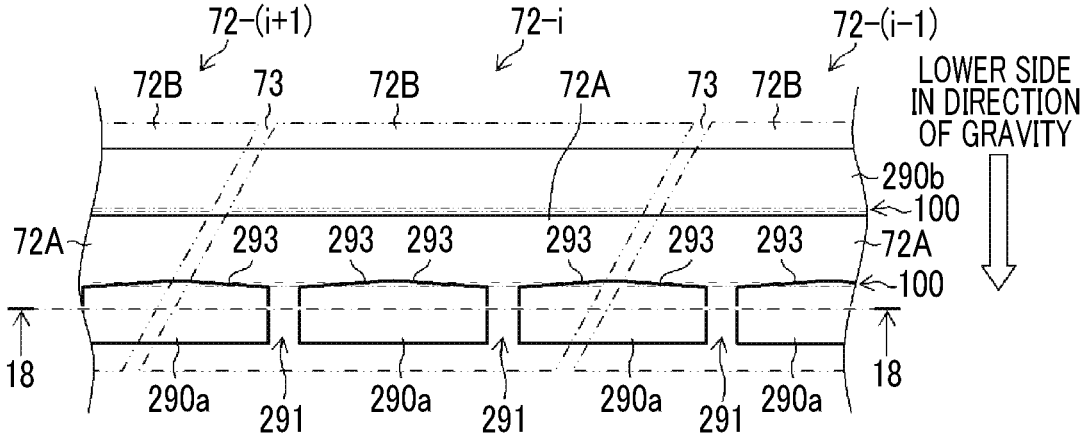
FIG. 17 is a view showing the head modules and liquid infiltration-preventing pads of another aspect.
Figure 18:
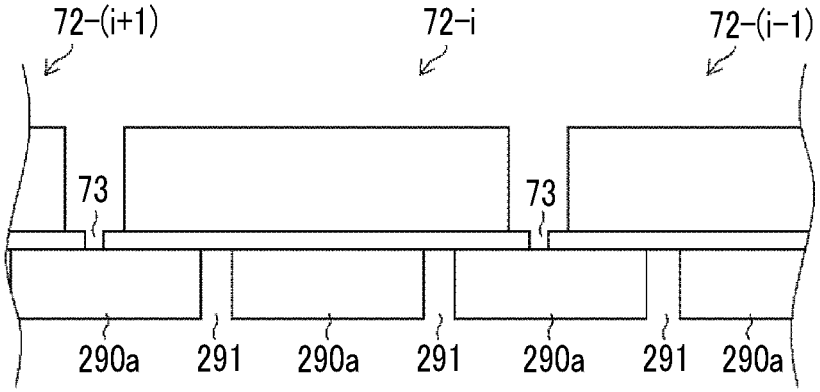
FIG. 18 is a cross-sectional view taken along line 18-18 of FIG. 17.

FIGS. 17 and 18 show a more preferable aspect of the liquid infiltration-preventing pad 290*a* shown in FIGS. 15 and 16. FIG. 17 is a bottom view of the head modules 72-*i* and the liquid infiltration-preventing pads 290*a* and 290*b* that are viewed from below, and FIG. 18 is a cross-sectional view taken along line 18-18 of FIG. 17.

The liquid infiltration-preventing pads 290*a* shown in FIGS. 17 and 18 correspond to an aspect in which one head module has two or more flow passages 291. That is, the liquid infiltration-preventing pads 290*a*, which are provided on the lower side in the direction of gravity, correspond to an aspect in which pads more than the liquid infiltration-preventing pads 290*a* shown in FIGS. 15 and 16 are arranged at intervals and one head module 72-*i* has two or more flow passages 291. Meanwhile, the others are the same as those of FIGS. 15 and 16.

Since one head module 72-*i* has two or more flow passages 291 of the liquid infiltration-preventing pads 290*a*, capacity for collecting the ink is further improved. Accordingly, in the case where the pressure purging of the droplet-discharging head is performed, it is possible to further prevent an ink, which overflows from the nozzles, from infiltrating into the head module gap.

Figure 19:
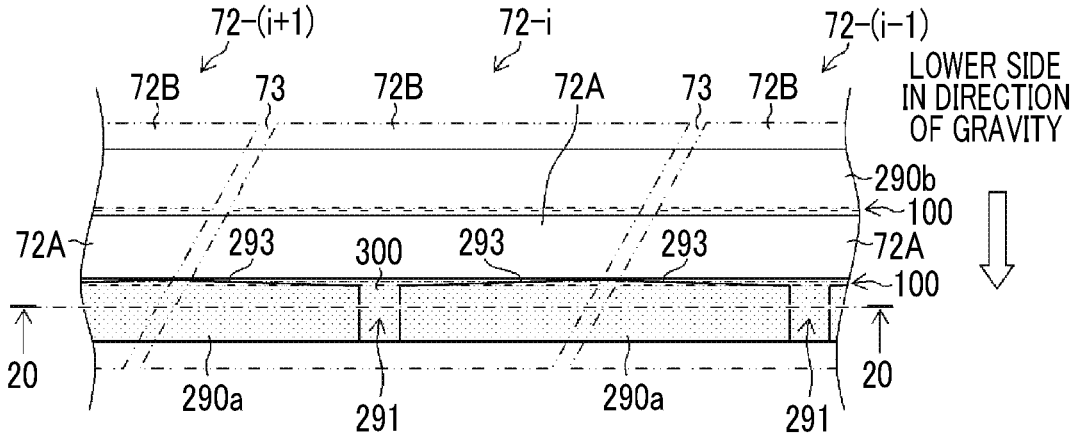
FIG. 19 is a view showing the head modules and liquid infiltration-preventing pads of another aspect.
Figure 20:
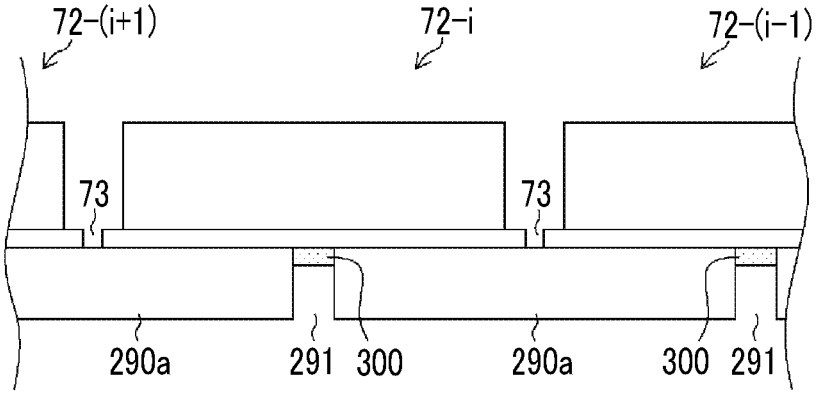
FIG. 20 is a cross-sectional view taken along line 20-20 of FIG. 19.

FIGS. 19 and 20 show a more preferable aspect of the liquid infiltration-preventing pad 290*a* shown in FIGS. 15 and 16. FIG. 19 is a bottom view of the head modules 72-*i* and the liquid infiltration-preventing pads 290*a* and 290*b* that are viewed from below, and FIG. 20 is a cross-sectional view taken along line 20-20 of FIG. 19.

The liquid infiltration-preventing pad 290*a* shown in FIGS. 19 and 20 is a liquid infiltration-preventing pad that includes pads 300, which have a small height, installed between the liquid infiltration-preventing pads 290*a* of FIGS. 15 and 16 so as to be formed as one member. Meanwhile, the others are the same as those of FIGS. 15 and 16.

In the liquid infiltration-preventing pads 290*a* shown in FIGS. 15 and 16, the gaps 100 between the nozzle surfaces 72A and the head module support members 72B of the head modules cannot be completely closed due to the flow passage 291. Accordingly, it is not possible to completely prevent an ink infiltration mode in which an ink flows along the gaps 100 between the nozzle surfaces 72A and the head module support members 72B of the head modules. It is possible to completely prevent the gaps 100 between the nozzle surfaces 72A and the head module support members 72B of the head modules by forming a liquid infiltration-preventing pad like the liquid infiltration-preventing pad 290*a* shown in FIGS. 19 and 20.

Figure 21:
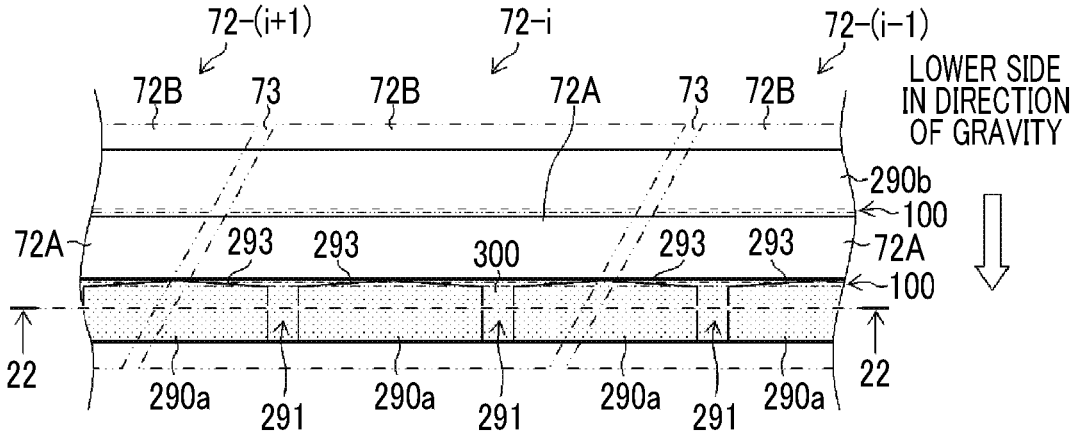
FIG. 21 is a view showing the head modules and liquid infiltration-preventing pads of another aspect.
Figure 22:
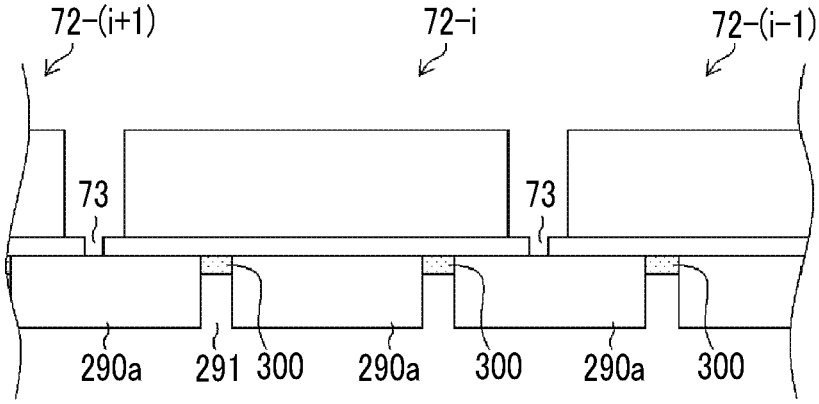
FIG. 22 is a cross-sectional view taken along line 22-22 of FIG. 21.

FIGS. 21 and 22 show a more preferable aspect of the liquid infiltration-preventing pad 290*a* shown in FIGS. 17 and 18. FIG. 21 is a bottom view of the head modules 72-*i* and the liquid infiltration-preventing pads 290*a* and 290*b* that are viewed from below, and FIG. 22 is a cross-sectional view taken along line 22-22 of FIG. 21.

The liquid infiltration-preventing pad 290*a* shown in FIGS. 21 and 22 is a liquid infiltration-preventing pad that includes pads 300, which have a small height, installed between the liquid infiltration-preventing pads 290*a* of FIGS. 17 and 18 so as to be formed as one member. Meanwhile, the others are the same as those of FIGS. 17 and 18.

In the liquid infiltration-preventing pad 290*a* of FIGS. 17 and 18, the gaps 100 between the nozzle surfaces 72A and the head module support members 72B of the head modules cannot be completely closed due to the flow passage 291 as in the case of the liquid infiltration-preventing pad 290*a* of FIGS. 15 and 16. Accordingly, it is not possible to completely prevent an ink infiltration mode in which an ink flows along the gaps 100 between the nozzle surfaces 72A and the head module support members 72B of the head modules. It is possible to completely prevent the gaps 100 between the nozzle surfaces 72A and the head module support members 72B of the head modules by forming a liquid infiltration-preventing pad like the liquid infiltration-preventing pad 290*a* shown in FIGS. 21 and 22.

Meanwhile, as shown in FIG. 6, a nozzle surface cleaning device 260, which cleans the nozzle surfaces 72AM, 72AK, 72AC, and 72AY of the respective inkjet heads 72M, 72K, 72C, and 72Y, is provided between the image recording position and the retracted position. While each of the inkjet heads 72M, 72K, 72C, and 72Y is moved to the image recording position from the retracted position, or while each of the inkjet heads 72M, 72K, 72C, and 72Y is moved to the retracted position from the image recording position, the nozzle surfaces 72AM, 72AK, 72AC, and 72AY are cleaned by the nozzle surface cleaning device 260.

As shown in FIG. 6, the nozzle surface cleaning device 260 comprises a cleaning solution applying unit 262 and a nozzle surface wiping unit 264.

The cleaning solution applying unit 262 applies a cleaning solution to the nozzle surfaces 72AM, 72AK, 72AC, and 72AY of the respective inkjet heads 72M, 72K, 72C, and 72Y that are moved to the retracted position from the image recording position.

The nozzle surface wiping unit 264 wipes the nozzle surfaces 72AM, 72AK, 72AC, and 72AY by allowing a wiping web to come into pressure contact with the nozzle surfaces 72AM, 72AK, 72AC, and 72AY of the respective inkjet heads 72M, 72K, 72C, and 72Y to which the cleaning solution has been applied.

The cleaning solution applying unit 262 and the nozzle surface wiping unit 264 are disposed on the movement path of the head support frame 240. In this case, the nozzle surface wiping unit 264 is disposed closer to the retracted position than the cleaning solution applying unit 262. Accordingly, in the case where the respective inkjet heads 72M, 72K, 72C, and 72Y are moved to the retracted position from the image recording position, it is possible to wipe the nozzle surfaces 72AM, 72AK, 72AC, and 72AY by the wiping web after applying a cleaning solution.

EXPLANATION OF REFERENCES

10: inkjet recording apparatus
12: sheet feed section
14: treatment liquid applying section
16: drawing section
18: drying section
20: fixing section
22: discharge section
24: recording medium
70: drawing drum
72: inkjet head (droplet-discharging head)
72A: nozzle surface
72B: head module support member
73: gap between head modules
100: gap
151: nozzle
250: maintenance unit
260: nozzle surface cleaning device
262: cleaning solution applying unit
264: nozzle surface wiping unit
280: receiving member (cap)
282: moisture retention cap
290*a*: liquid infiltration-preventing pad (provided on lower side in direction of gravity)
290*b*: liquid infiltration-preventing pad (provided on upper side in direction of gravity)
291: flow passage
292*a*, 292*b*: support member
293: end face on upper side in direction of gravity
300: pad having small height

What is claimed is:

1. An image printing apparatus comprising:

a droplet-discharging head in which a plurality of head modules having nozzle surfaces in which a plurality of nozzles discharging liquid are disposed are fixed and joined by head module support members, and the nozzle surfaces are inclined with respect to a horizontal plane;

a receiving member that receives the liquid discharged from the nozzles in the case where the droplet-discharging head performs pressure purging; and a liquid infiltration-preventing pad provided on the receiving member, which comes into contact with the droplet-discharging head during the pressure purging, and prevents the liquid discharged by the pressure purging to infiltrate into gaps between the head modules, wherein the liquid infiltration-preventing pad is a plurality of pads having flow passages of gaps formed at positions of the head module support members, which is made of a non-absorbent material that does not absorb the liquid, and in which the liquid discharged by the pressure purging is collected by the inclination of the nozzle surfaces, and the plurality of pads close gaps between the nozzle surfaces and the head module support members by non-flow passages, the nozzle surfaces being provided on a lower side in a direction of gravity, of the nozzle surfaces, which are inclined with respect to the horizontal plane.

2. An image printing apparatus comprising:

a droplet-discharging head in which a plurality of head modules having nozzle surfaces in which a plurality of nozzles discharging liquid are disposed are fixed and joined by head module support members and the nozzle surfaces are inclined with respect to a horizontal plane;

a receiving member that receives the liquid discharged from the nozzles in the case where the droplet-discharging head performs pressure purging; and a liquid infiltration-preventing pad that is provided in the receiving member, comes into contact with the droplet-discharging head during the pressure purging, and prevents the liquid, which is discharged by the pressure purging, from infiltrating into gaps between the head modules, wherein the liquid infiltration-preventing pad is made of a non-absorbent material that does not absorb the liquid and is a series of pads that close gaps between the nozzle surfaces and the head module support members, the nozzle surfaces being provided on a lower side in a direction of gravity, of the nozzle surfaces, and are inclined with respect to the horizontal plane, the plurality of pads have flow passages which are formed on non-contact surfaces of the pads not coming into contact with the droplet-discharging head and in which the liquid discharged by the pressure purging is collected.

3. The image printing apparatus according to claim 1, wherein an end face, which is provided on the upper side in the direction of gravity with respect to the droplet-discharging head, of the liquid infiltration-preventing pad is formed to be inclined so that the liquid discharged by the pressure purging is guided to the flow passages.

4. The image printing apparatus according to claim 2, wherein an end face, which is provided on the upper side in the direction of gravity with respect to the droplet-discharging head, of the liquid infiltration-preventing pad is formed to be inclined so that the liquid discharged by the pressure purging is guided to the flow passages.

5. The image printing apparatus according to claim 1, wherein the liquid infiltration-preventing pad further has a series of pads that close gaps between the nozzle surfaces and the head module support members, the nozzle surfaces being provided on an upper side in the direction of gravity, of the nozzle surfaces, which are inclined with respect to the horizontal plane.

6. The image printing apparatus according to claim 2, wherein the liquid infiltration-preventing pad further has a series of pads that close gaps between the nozzle surfaces and the head module support members, the nozzle surfaces being provided on an upper side in the direction of gravity, of the nozzle surfaces, which are inclined with respect to the horizontal plane.

7. The image printing apparatus according to claim 3, wherein the liquid infiltration-preventing pad further has a series of pads that close gaps between the nozzle surfaces and the head module support members, the nozzle surfaces being provided on an upper side in the direction of gravity, of the nozzle surfaces, which are inclined with respect to the horizontal plane.

8. The image printing apparatus according to claim 4, wherein the liquid infiltration-preventing pad further has a series of pads that close gaps between the nozzle surfaces and the head module support members, the nozzle surfaces being provided on an upper side in the direction of gravity, of the nozzle surfaces, which are inclined with respect to the horizontal plane.

9. The image printing apparatus according to claim 1, wherein one head module has two or more flow passages.

10. The image printing apparatus according to claim 2, wherein one head module has two or more flow passages.

11. The image printing apparatus according to claim 3, wherein one head module has two or more flow passages.

12. The image printing apparatus according to claim 4, wherein one head module has two or more flow passages.

13. The image printing apparatus according to claim 5, wherein one head module has two or more flow passages.

14. The image printing apparatus according to claim 6, wherein one head module has two or more flow passages.

15. The image printing apparatus according to claim 7, wherein one head module has two or more flow passages.

16. The image printing apparatus according to claim 8, wherein one head module has two or more flow passages.

17. The image printing apparatus according to claim 1, wherein the liquid infiltration-preventing pad is formed of an elastic body.

18. The image printing apparatus according to claim 1, wherein an end face of the liquid infiltration-preventing pad is treated with hydrophilic treatment.

19. The image printing apparatus according to claim 1, wherein the liquid infiltration-preventing pad is fixed to the receiving member via a support member.

20. The image printing apparatus according to claim 1, wherein the receiving member comprises a moisture retention cap that retains moisture of the nozzle surface, and the liquid, which is discharged from the nozzles in the case where the pressure purging is performed, is received in the receiving member.

* * * * *